US012490821B2

(12) United States Patent
Adams et al.

(10) Patent No.: US 12,490,821 B2
(45) Date of Patent: Dec. 9, 2025

(54) MODULAR COSMETIC CONTAINER ASSEMBLY

(71) Applicant: VB Creative LLC, Maplewood, NJ (US)

(72) Inventors: Michael Adams, Maplewood, NJ (US); Viktorija Adams, Maplewood, NJ (US)

(73) Assignee: VB Creative LLC, Maplewood, NJ (US)

( * ) Notice: Subject to any disclaimer, the term of this patent is extended or adjusted under 35 U.S.C. 154(b) by 322 days.

(21) Appl. No.: 18/193,739

(22) Filed: Mar. 31, 2023

(65) Prior Publication Data

US 2024/0324750 A1 Oct. 3, 2024

(51) Int. Cl.
*A45D 33/28* (2006.01)

(52) U.S. Cl.
CPC ..... *A45D 33/28* (2013.01)

(58) Field of Classification Search
CPC ..... A45D 33/00; A45D 33/008; A45D 33/20; A45D 33/28; A45D 40/00; A45D 40/24
See application file for complete search history.

(56) References Cited

U.S. PATENT DOCUMENTS 4,421,127 A * 12/1983 Geer ..... A45D 40/22 206/823
4,826,014 A 5/1989 Schefer
5,005,697 A * 4/1991 Jimbo ..... A45C 13/02 206/823
6,386,209 B1 * 5/2002 Yuhara ..... A45D 33/006 206/205
D723,742 S 3/2015 Shteysel
10,912,367 B2 * 2/2021 Kim ..... B65D 51/24
2004/0206370 A1 * 10/2004 Byun ..... A45D 33/20 132/287
2008/0017596 A1 * 1/2008 Brock ..... A45D 42/00 211/10
2010/0319723 A1 * 12/2010 Parker ..... A45D 33/20 132/287
2011/0253167 A1 * 10/2011 Shteysel ..... A45D 40/24 132/314
2016/0270507 A1 * 9/2016 Thompson ..... A45D 33/006
2018/0263361 A1 * 9/2018 Langdon ..... A45D 33/20
2019/0008261 A1 * 1/2019 Olivari ..... A45D 34/00
2019/0059557 A1 * 2/2019 Kehoe ..... A45D 40/24
2019/0387864 A1 * 12/2019 Hong ..... A45D 33/28
(Continued)

FOREIGN PATENT DOCUMENTS

JP 2000000114 A * 1/2000

OTHER PUBLICATIONS

JP-2000000114-A. Translated Document (Year: 2000).*

*Primary Examiner* — Rachel R Steitz
*Assistant Examiner* — Karim Asqiriba
(74) *Attorney, Agent, or Firm* — Barley Snyder

(57) ABSTRACT

A modular cosmetic container assembly includes a base having a bottom wall and a plurality of sidewalls defining an insert receiving space, and a plurality of inserts removably insertable into the insert receiving space. Each of the inserts has a same plurality of outer dimensions and at least one well. The inserts differ in a number of the wells in each of the inserts. The insert receiving space is sized to receive at least two of the plurality of inserts that are all interchangeably positionable in the insert receiving space.

14 Claims, 7 Drawing Sheets

(56) References Cited

U.S. PATENT DOCUMENTS

| | | | | |
|---|---|---|---|---|
| 2020/0146421 | A1* | 5/2020 | Chen | A45D 33/008 |
| 2020/0146424 | A1* | 5/2020 | Edgemon | A45D 40/24 |
| 2021/0022480 | A1* | 1/2021 | Sobol | A45D 40/24 |
| 2022/0031046 | A1* | 2/2022 | Sobol | A45D 40/22 |
| 2022/0408898 | A1* | 12/2022 | Cheng | A45D 33/006 |
| 2023/0240430 | A1* | 8/2023 | Cheng | A45D 33/24<br>132/314 |
| 2024/0164506 | A1* | 5/2024 | Tanaka | A45D 33/008 |
| 2024/0365953 | A1* | 11/2024 | Richards | A45D 40/22 |

* cited by examiner

MODULAR COSMETIC CONTAINER ASSEMBLY

FIELD OF THE INVENTION

The present invention relates to a container and, more particularly, to a modular cosmetic container assembly.

BACKGROUND

A cosmetic artist or other user of cosmetic materials often needs to transport a wide array of the cosmetic materials, such as solutions, creams, oils, pastes, or powders. In their original packaging, however, the cosmetic materials are bulky, difficult to use, and contain a larger quantity of the cosmetic material than is necessary to transport or use for any one application. Transporting a larger than necessary quantity of cosmetic material is heavy, inefficient to sort through, and risks spoilage of large quantities of expensive cosmetics through repeated opening and closing of the original containers.

SUMMARY

A modular cosmetic container assembly includes a base having a bottom wall and a plurality of sidewalls defining an insert receiving space, and a plurality of inserts removably insertable into the insert receiving space. Each of the inserts has a same plurality of outer dimensions and at least one well. The inserts differ in a number of the wells in each of the inserts. The insert receiving space is sized to receive at least two of the plurality of inserts that are all interchangeably positionable in the insert receiving space.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
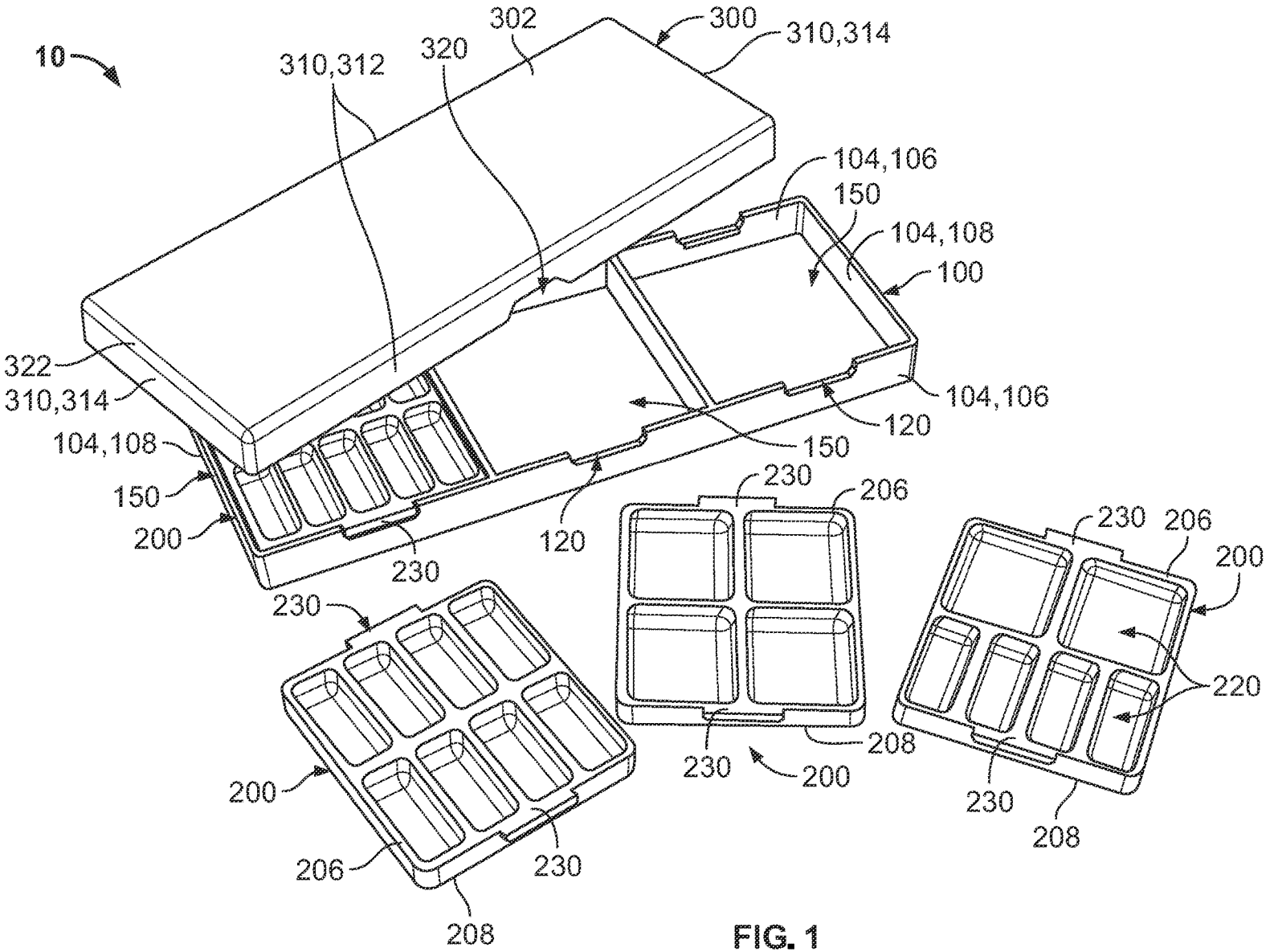
FIG. 1 is a perspective view of a modular cosmetic container assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth to provide a thorough understanding of the disclosed embodiments. However, it is apparent that one or more embodiments may also be implemented without these specific details.

Throughout the drawings, only one of a plurality of identical elements may be labeled in a figure for clarity of the drawings, but the detailed description of the element herein applies equally to each of the identically appearing elements in the figure. Throughout the specification, directional descriptors are used such as "longitudinal direction", "depth direction", and "width direction". These descriptors are merely for clarity of the description and for differentiation of the various directions. These directional descriptors do not imply or require any particular orientation of the disclosed elements.

A modular cosmetic container assembly 10 according to an embodiment is shown in FIG. 1. The modular cosmetic container assembly 10 includes a base 100, a plurality of inserts 200 removably insertable in the base 100, and a lid 300 that is attachable to the base 100 to contain the inserts 200.

As described in greater detail below, the inserts 200 are interchangeable and, in some embodiments, there may be more interchangeable inserts 200 than can fit in the base 100 at a given time. The term modular cosmetic container assembly 10 as used herein refers to the base 100, the lid 300, and the plurality of possible inserts 200 that can fit in the base 100, even if the number of inserts 200 in the assembly 10 exceeds the number of inserts 200 that can fit in the base 100 at a given time. The term modular cosmetic container assembly 10 also refers to the assembly of the base 100, the inserts 200 that fit in the base 100 at a given time, and the lid 300 attached to the base 100 to contain the inserts 200.

Figure 2A:
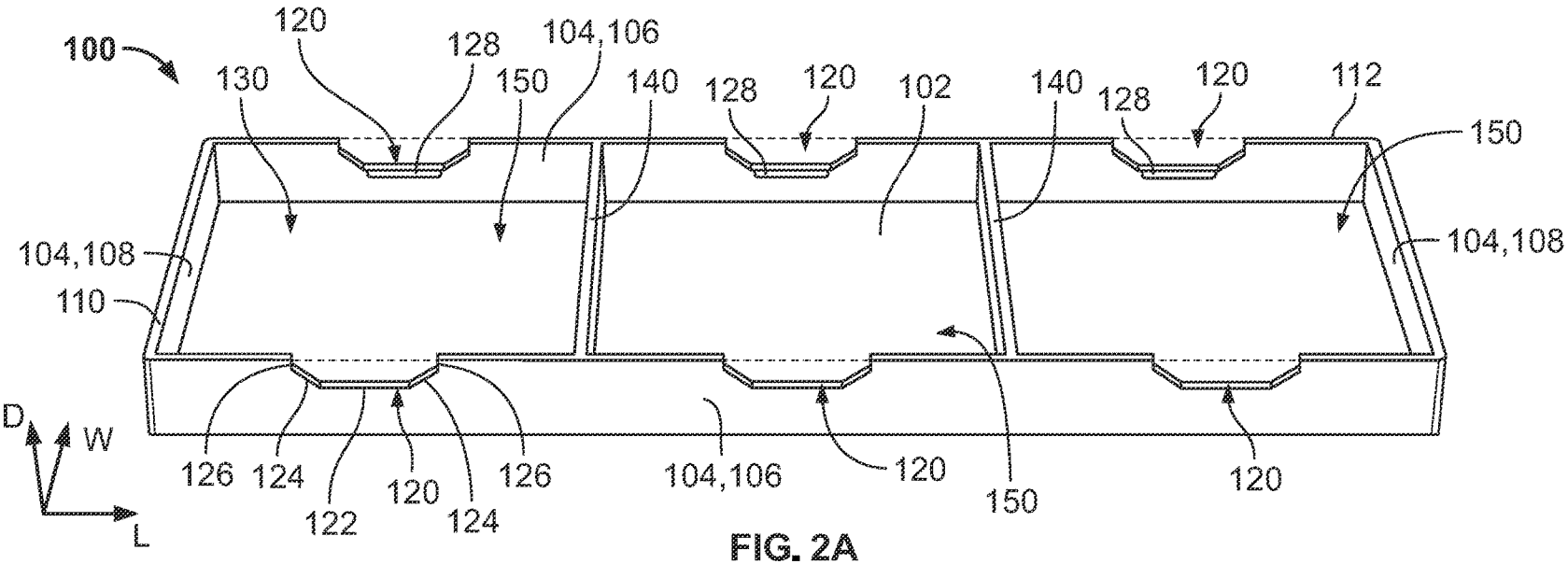
FIG. 2A is a perspective view of a base according to an embodiment.

The base 100, as shown in FIGS. 2A, includes a bottom wall 102 and a plurality of sidewalls 104 extending from the bottom wall 102 in a depth direction D. The sidewalls 104 include a pair of first walls 106 extending parallel to one another in a longitudinal direction L perpendicular to the depth direction D and spaced apart from one another in a width direction W perpendicular to the longitudinal direction L and the depth direction D. The sidewalls 104 include a pair of second walls 108 extending parallel to one another in the width direction W and spaced apart from one another in the longitudinal direction L. The first walls 106 have a larger length in the longitudinal direction L than a length of the second walls 108 in the width direction W. The sidewalls 104 form an upper surface 110 of the base 100 in the depth direction D and define an exterior dimension 112 of the base 110.

As shown in FIG. 2A, the base 100 has a plurality of notches 120 in the sidewalls 104. In the shown embodiment, the base 100 has a plurality of notches 120 in each of the first walls 106, with the notches 120 aligned with one another along the width direction W. The notches 120 each have a lower surface 122 parallel to the bottom wall 102 and extending in the longitudinal direction L, a pair of slanted surfaces 124 extending at an angle from opposite sides of the lower surface 122, and a pair of upper surfaces 126 extending in the depth direction D from the slanted surfaces 124 to the upper surface 110 of the sidewalls 104.

The bottom wall 102 and the sidewalls 104 define an insert receiving space 130 of the base 100, shown in FIG. 2A. In the shown embodiment, the base 100 has a plurality of dividers 140 in the insert receiving space 130 that extend between the sidewalls 104 and form a plurality of bays 150 of the base 100. Each of the first walls 106 has a number of notches 120 corresponding with the number of bays 150, with one notch 120 positioned centrally aligned with each of the bays 150. In another embodiment, the dividers 140 can be omitted, and the insert receiving space 130 is open between the first walls 106 and the second walls 108, with the notches 120 in the same positions as described above and shown in FIG. 2A.

The base 100, as shown in FIG. 2A, has a plurality of protrusions 128 on an inner surface of each of the first walls 106. The protrusions 128 are each positioned below one of the notches 120 and extend into the insert receiving space 130. In the shown embodiment, each of the bays 150 has a pair of protrusions 128, one on each of the first walls 106, that are positioned opposite one another in the width direction W. In an embodiment, the protrusions 128 protrude from the first wall 106 approximately 1 mm into the insert receiving space 130 and have a dimension in the longitudinal direction L approximately equal to the lower surface 122 of the notch 120. In other embodiments, the protrusions 128 may be positioned on only one of the first walls 106 and/or may have different dimensions than those shown and described.

In an embodiment, the base 100 is monolithically formed in a single piece from a food-grade plastic material. In another embodiment, the base 100 can be formed from a plurality of pieces of food-grade plastic material and assembled together to have the components described herein. The food-grade plastic material of the base 100, in various embodiments, can be transparent or translucent.

Figure 2B:
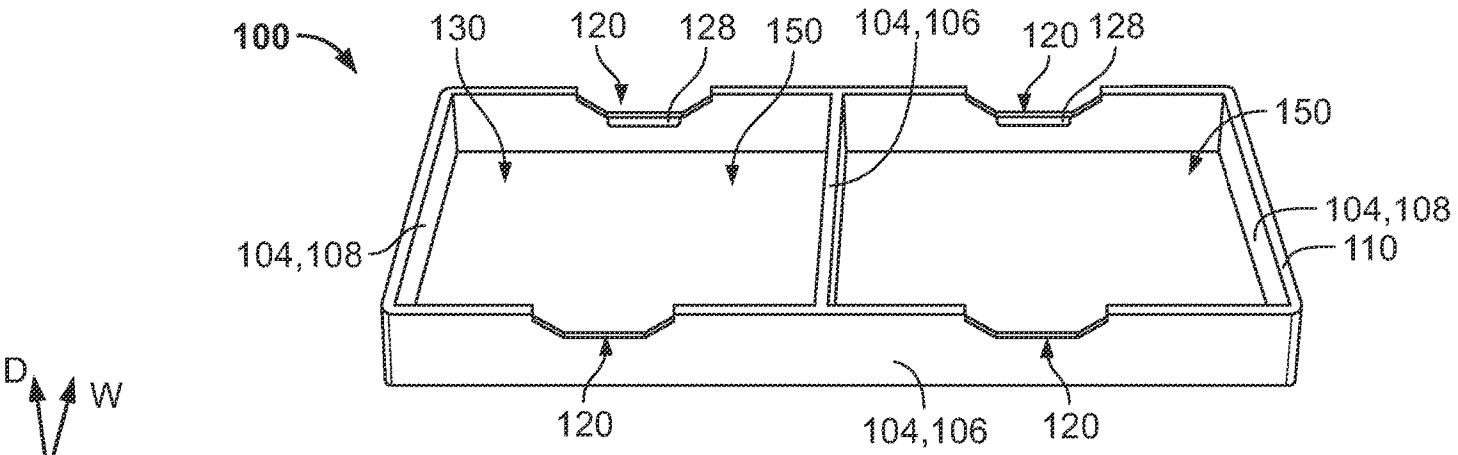
FIG. 2B is a perspective view of a base according to another embodiment.
Figure 2C:
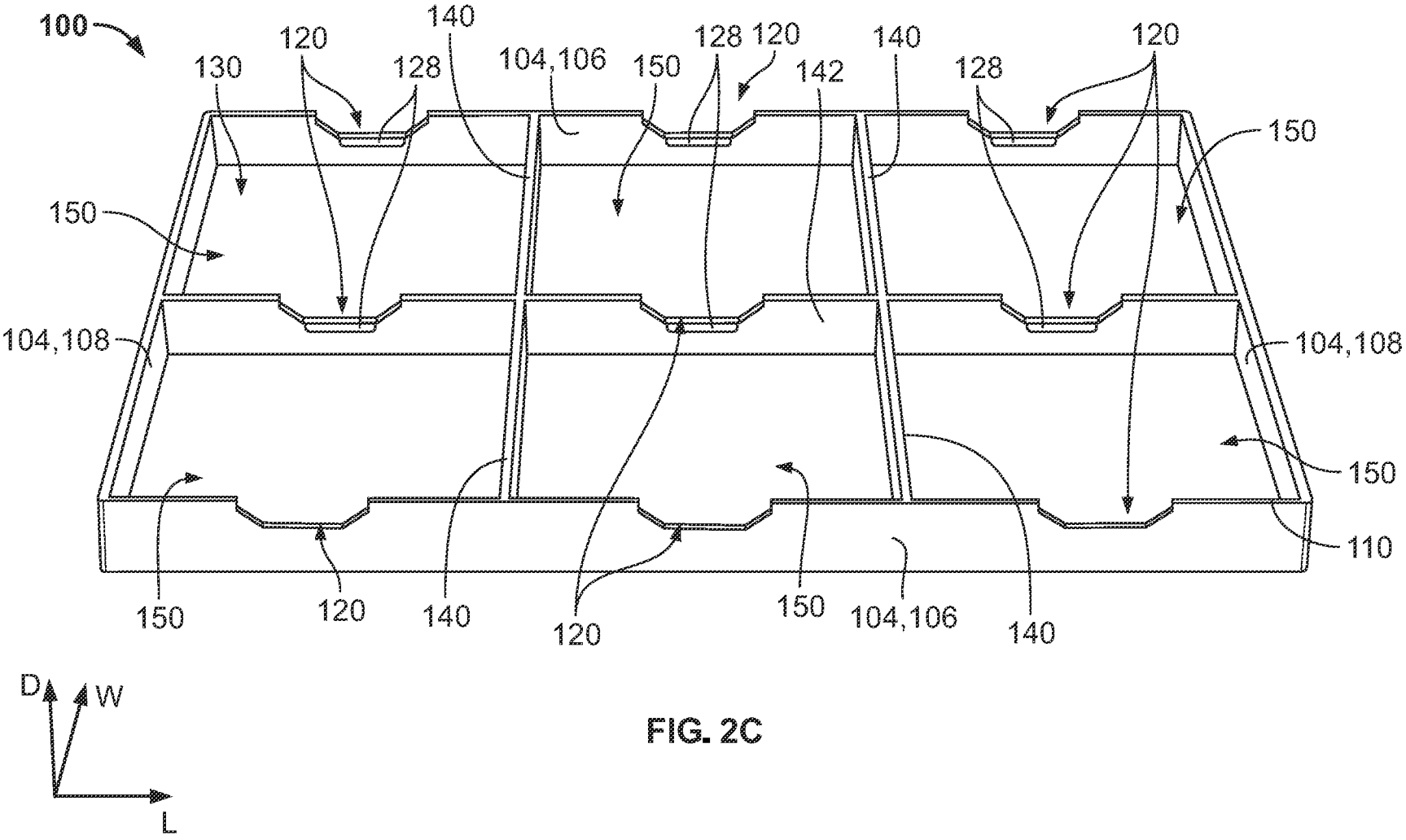
FIG. 2C is a perspective view of a base according to another embodiment.

Other embodiments of the base 100 are shown in FIGS. 2B and 2C. For clarity of the drawings, some of the reference numbers appearing in FIG. 2A are omitted in FIGS. 2B and 2C, but the same numbers and description apply to identically appearing elements.

As shown in FIGS. 2B and 2C, the length of the first walls 106 and the second walls 108 can vary in different embodiments to form bases 100 of different sizes. In the embodiment of FIG. 2B, the first walls 106 are shorter than the first walls 106 of the embodiment of FIG. 2A, and the second walls 108 have a same length in the width direction W as the second walls 108 in the embodiment of FIG. 2A. The base 100 of FIG. 2B has one divider 140 extending between the sidewalls 104 to form two bays 150; each of the bays 150 in FIG. 2B has the same dimension and shape as the bays 150 of FIG. 2A. The notches 120 and protrusions 128 of the embodiment of FIG. 2B correspond to the bays 150 in the same manner as in the embodiment of FIG. 2A.

In the embodiment of FIG. 2C, the sidewalls 104 and dividers 140 of the base 100 form multiple rows of bays 150 extending in the longitudinal direction L and adjacent to one another in the width direction W. The first walls 106 of the embodiment of FIG. 2C have a same length as the first walls 106 of the embodiment of FIG. 2A, and the second walls 108 are longer in the width direction W than the second walls 108 in the embodiment of FIG. 2A. The base 100 of FIG. 2C has four dividers 140 and one partition 142 positioned centrally in the insert receiving space 130 and extending between the second walls 108 in the longitudinal direction L; the divider 140 and partition 142 form six bays 150 in the embodiment of FIG. 2C. Each of the bays 150 in FIG. 2C has the same dimension and shape as the bays 150 of FIGS. 2A and 2B. The notches 120 and protrusions 128 are positioned in the first walls 106 and in the partition 142 in correspondence to each of the bays 150. The partition 142 in the embodiment of FIG. 2C separating the rows of bays 150 has a thickness in the width direction W that is double a thickness of the dividers 140 in the longitudinal direction L.

The embodiments of the base 100 and the number of bays 150 included in the base 100 in each embodiment are merely exemplary. In other embodiments, the base 100 may have more than three bays 150 aligned in one row along the longitudinal direction L, or may have any number of bays 150 in any number of rows adjacent to one another in the width direction W, provided that in all embodiments the bays 150 have a same dimension and shape and the notches 120 are positioned centrally and opposite one another in correspondence to each bay 150.

Figures 3A, 3B:
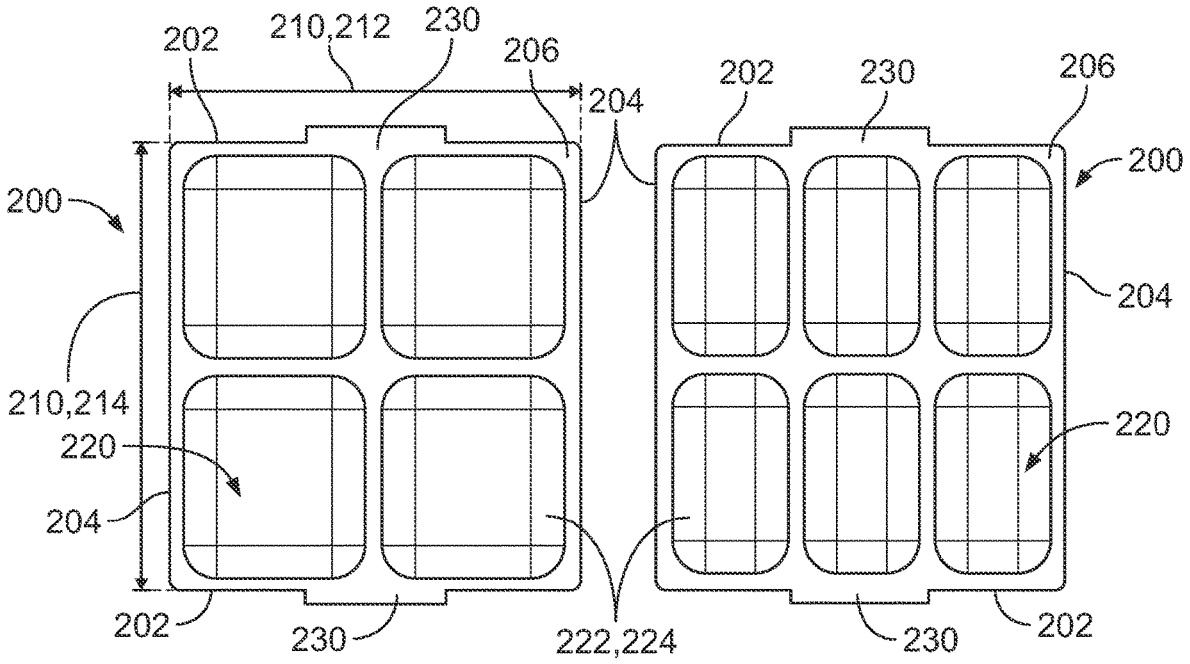
FIG. 3A is a top view of an insert according to an embodiment.
FIG. 3B is a top view of an insert according to another embodiment.
Figures 3C, 3D:
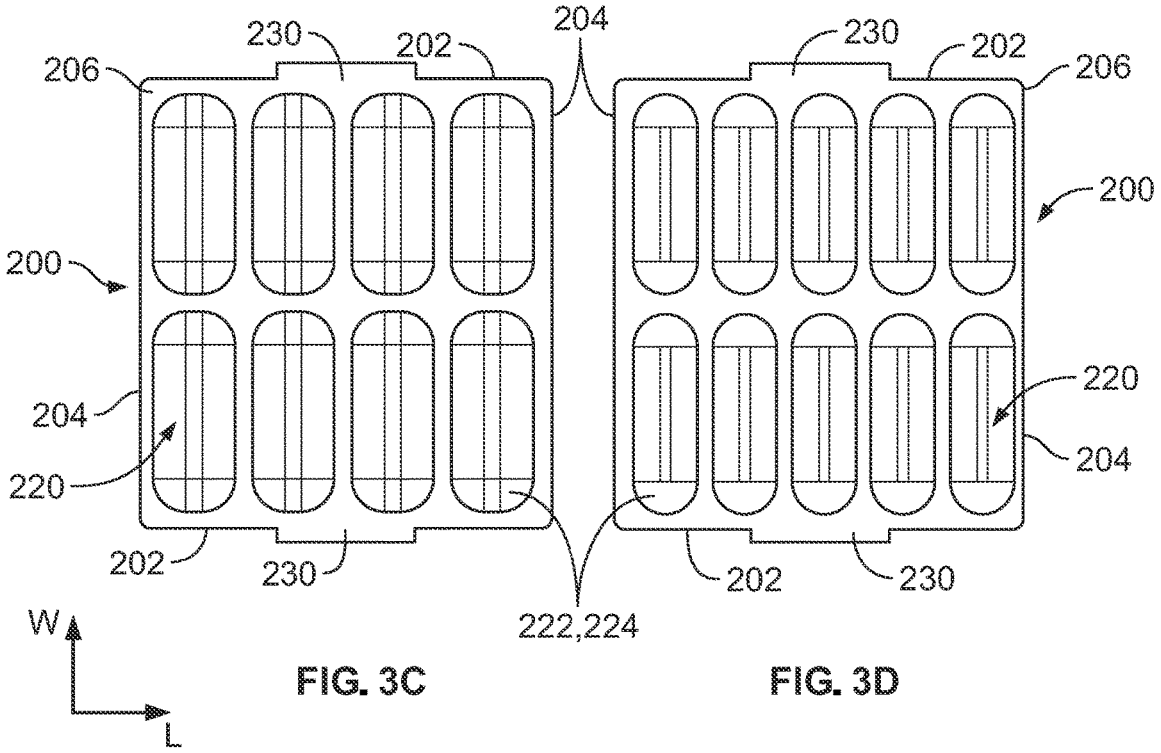
FIG. 3C is a top view of an insert according to another embodiment.
FIG. 3D is a top view of an insert according to another embodiment.
Figure 3E:
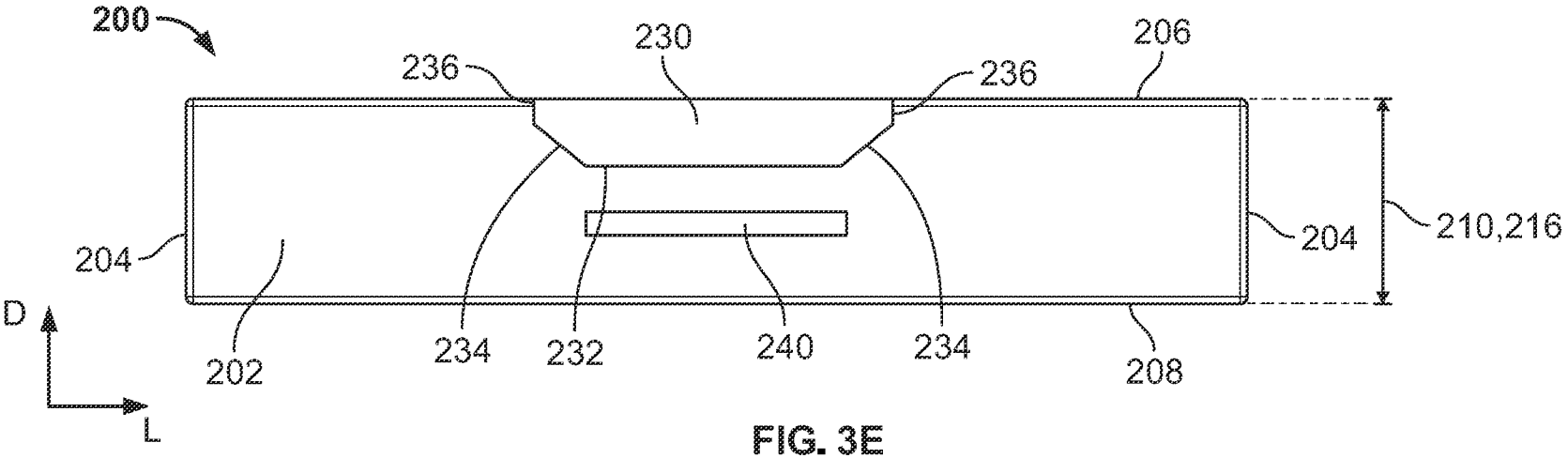
FIG. 3E is a side view of the insert.

The inserts 200 are shown in FIG. 1 and in FIGS. 3A-3E. FIGS. 1 and 3A-3D show a perspective view and top view of a plurality of different inserts 200, while FIG. 3E shows a side view that is the same for each of the inserts 200 shown in FIGS. 1 and 3A-3D.

The inserts 200 have a pair of first sides 202 extending parallel to one another in the longitudinal direction L and a pair of second sides 204 connecting the first sides 202 and extending parallel to one another in the width direction W. The inserts 200 each have a plurality of outer dimensions 210 that are the same across the various types of inserts 200 shown in FIGS. 1 and 3A-3D. The first sides 202 each have a first outer dimension 212 in the longitudinal direction L and the second sides 204 each have a second outer dimension 214 in the width direction W. In an embodiment, the first outer dimension 212 and the second outer dimension 214 may be the same, forming the insert 200 as a square shape, or the first outer dimension 212 and the second outer dimension 214 may be different to form the insert 200 as a rectangular shape.

Each insert 200 has an upper surface 206 and a lower surface 208 opposite the upper surface 206, as shown in FIGS. 1 and 3E; only the upper surface 206 is shown in the top view of FIGS. 3A-3D. Each insert 200 has a third outer dimension 216 of the outer dimensions 210 between the upper surface 206 and the lower surface 208 in the depth direction D.

The inserts 200 each have a plurality of wells 220 extending into the upper surface 206. As shown in FIGS. 1 and 3A-3D, the different types of inserts 200 differ in the number, the arrangement, and the sizes of the wells 200, while the outer dimensions 210 of the inserts 200 remain the same across the various types. In the embodiments of FIGS. 3A-3D, the inserts 200 each have an even number of wells 220, ranging from four wells 220 to ten wells 220, with each of the wells 220 having a same size and an identical shape. In other embodiments, the inserts 200 could have an uneven number of wells 220 and, as shown in one of the inserts 200 in the embodiment of FIG. 1, the wells 220 contained in one insert 200 can also differ in size and shape.

In the embodiments shown in FIGS. 3A-3D, the wells 220 are symmetrical about a center axis of the inserts 200 in the longitudinal direction L and the width direction W. In another embodiment of one of the inserts 200 shown in FIG. 1, the wells 220 are only symmetrical about a center axis of the inserts 200 in the width direction W.

Each of the inserts 200, as shown in FIGS. 3A-3D, has two wells 220 positioned adjacent to one another in the width direction W and a varying number of wells 220 positioned adjacent to one another in the longitudinal direction L. A dimension of each of the wells 220 is the same in the width direction W even as the shape, the size of the wells 220 along the longitudinal direction L, and the number of the wells 220 differs between the inserts 220.

Each of the wells 220 in the various inserts 200 has an inner surface 222 recessed into the upper surface of the insert 200, as shown in FIGS. 3A-3D. The inner surface 222 of each of the wells 220, in an embodiment, has a plurality of rounded sides and corners 224; the wells 220 in this embodiment do not have any straight or right-angle corners.

As shown in FIGS. 1 and 3A-3E, each of the inserts 200 has a pair of tabs 230 each extending from one of the first sides 202 of the insert 200 in the width direction W. The tabs 230, as shown in detail in FIG. 3E, each have a shape complementary to the notches 120, with a lower surface 232 parallel to the surfaces 206, 208 and extending in the longitudinal direction L, a pair of slanted surfaces 234 extending at an angle from opposite sides of the lower surface 232, and a pair of upper surfaces 236 extending in the depth direction D from the slanted surfaces 234 to the upper surface 206 of the insert 200.

Each of the inserts 200, as shown in FIG. 3E, has a ridge 240 protruding from each of the first sides 202 of the insert 200. The ridges 240 are each positioned below one of the tabs 230 and extend away from the first side 202 in the width direction W. In an embodiment, each of the inserts 200 has a pair of ridges 240, one on each of the first sides 202, that are positioned opposite one another in the width direction W. In an embodiment, the ridges 240 protrude approximately 1 mm from the first sides 202 and have a dimension in the longitudinal direction L approximately equal to the lower surface 232 of the tab 230. In other embodiments, the ridges 240 may be positioned on only one of the first sides 202 and/or may have different dimensions than those shown and described.

In an embodiment, the inserts 200 are each monolithically formed in a single piece from a food-grade plastic material. In another embodiment, the inserts 200 can each be formed from a plurality of pieces of food-grade plastic material and assembled together to have the components described herein. The food-grade plastic material of the inserts 200, in various embodiments, can be transparent or translucent.

Figure 4:
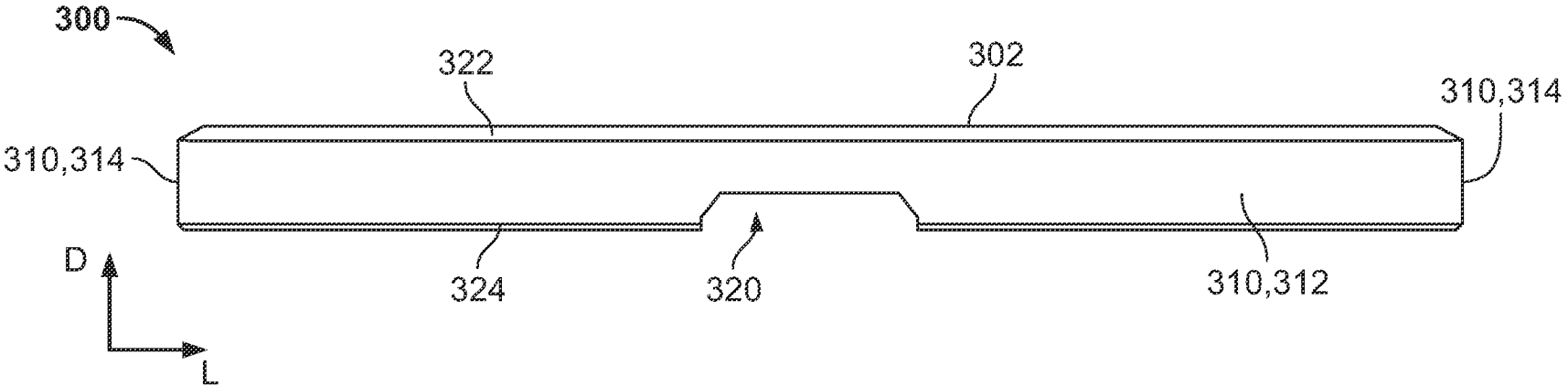
FIG. 4 is a side view of a lid according to an embodiment.

The lid 300 is shown in FIGS. 1 and 4. The lid 300 has an upper wall 302 and a plurality of sidewalls 310 extending from the upper wall 302 in the depth direction D. The sidewalls 310 include a pair of first walls 312 extending parallel to one another in the longitudinal direction L and a pair of second walls 314 connecting the first walls 312 and extending parallel to one another in the width direction W. The lid 300 has a recess 320 extending approximately centrally into each of the first walls 312. In an embodiment, the recess 320 has a shape identical to the notches 120. In other embodiments, the recesses 320 could have other shapes. As shown in FIG. 4, the lid 300 has an upper chamfer 322 at a connection of the sidewalls 310 with the upper wall 302 and a lower chamfer 324 at an end of each of the sidewalls 310 opposite the upper wall 302.

Figure 6A:
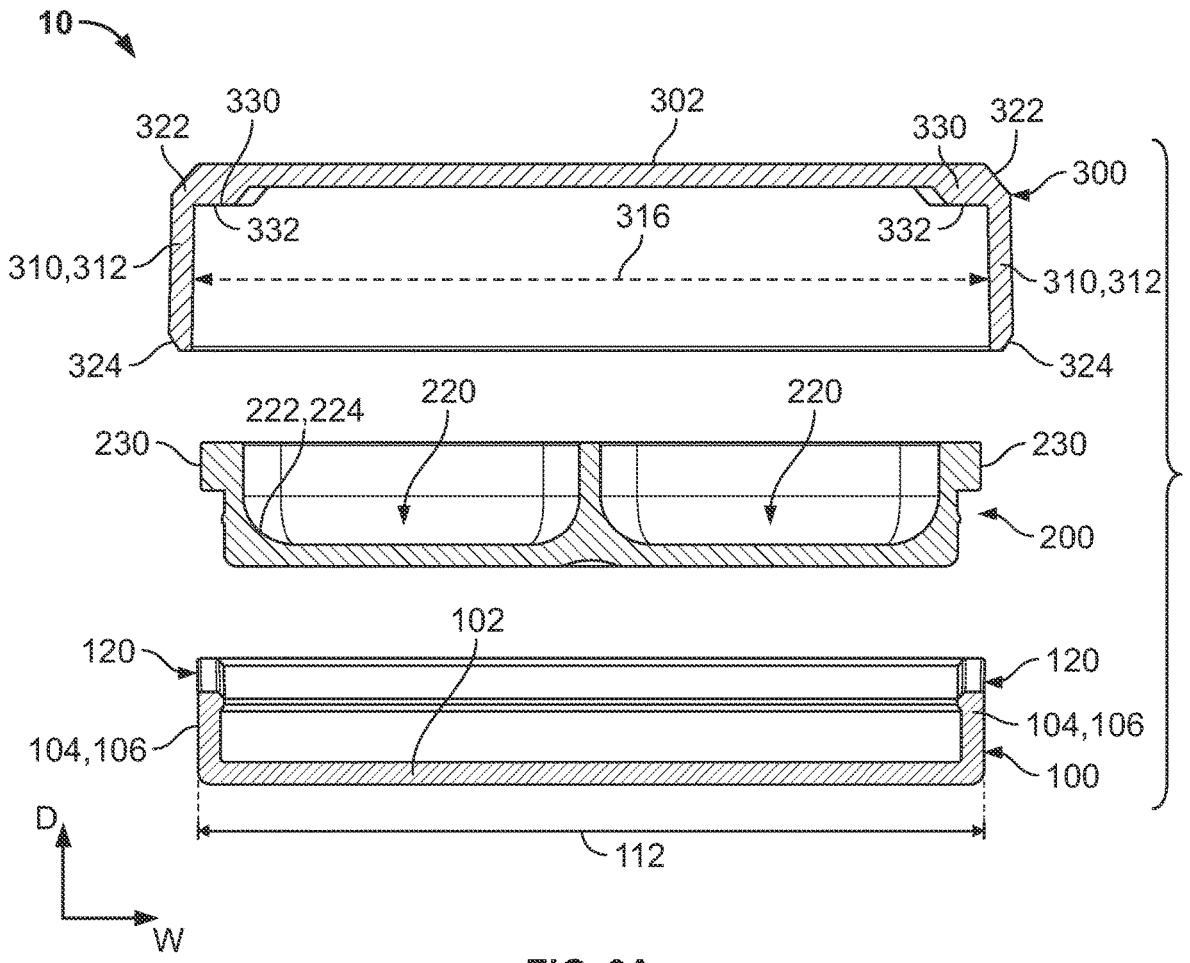
FIG. 6A is an exploded sectional side view of the modular cosmetic container assembly.

As shown in FIG. 6A, the lid 300 has an inner dimension 316 extending between the sidewalls 310; the inner dimension 316 is only shown between the first walls 312 of the sidewalls 310 in FIG. 6A, but applies similarly to the second walls 314 of the sidewalls 310. The lid 300 has an inner ledge 330 extending from an interior surface of the sidewalls 310 and connecting with an interior surface of the upper wall 302. The inner ledge 330 forms a flat surface 332 parallel with the upper wall 302 and facing in the depth direction D.

In an embodiment, the lid 300 is monolithically formed in a single piece from a food-grade plastic material. In another embodiment, the lid 300 can be formed from a plurality of pieces of food-grade plastic material and assembled together to have the components described herein. The food-grade plastic material of the lid 300, in various embodiments, can be transparent or translucent.

The assembly and use of the modular cosmetic container assembly 10 will now be described in greater detail primarily with reference to FIGS. 1 and 5-6B.

The inserts 200 to be used and assembled with the assembly 10 are first selected from the plurality of available inserts 200, which differ as described above. A user selects inserts 200 with a size and number of wells 220 suitable for the present application. The wells 220 can each be filled with a cosmetic material, such as solutions, creams, oils, pastes, powders, or any other type of cosmetic material known to those with ordinary skill in the art; the inserts 200 having the particular number and sizes of wells 220 can be selected based on the quantity and range of cosmetic materials that need to be held in the assembly 10. The rounded sides and corners 224 of the wells 220 allow for easier removal of the cosmetic materials in the wells 220 during use and for easier cleaning of residual cosmetic materials from the wells 220 after use. In other embodiments, other materials can be held in the wells 220.

The base 100 of the assembly 10 is selected based on the number of inserts 200 desired for the application; an assembly 10 that is more portable and used for a smaller range of applications may require only the two bay 150 base 100 of FIG. 2B, while more extensive applications may require the three bay 150 base 100 of FIG. 2A, the six bay 150 base 100 of FIG. 2C, or even bases 100 having other numbers of bays 150.

Each of the inserts 200 is removably insertable in one of the bays 150 of the base 100. The insert receiving space 130 of each base 100, as shown in FIGS. 1-2C, has at least two bays 150 and is sized to receive a corresponding number of the plurality of inserts 200 that are all interchangeably positionable in the bays 150 of the insert receiving space 130.

Figure 5:
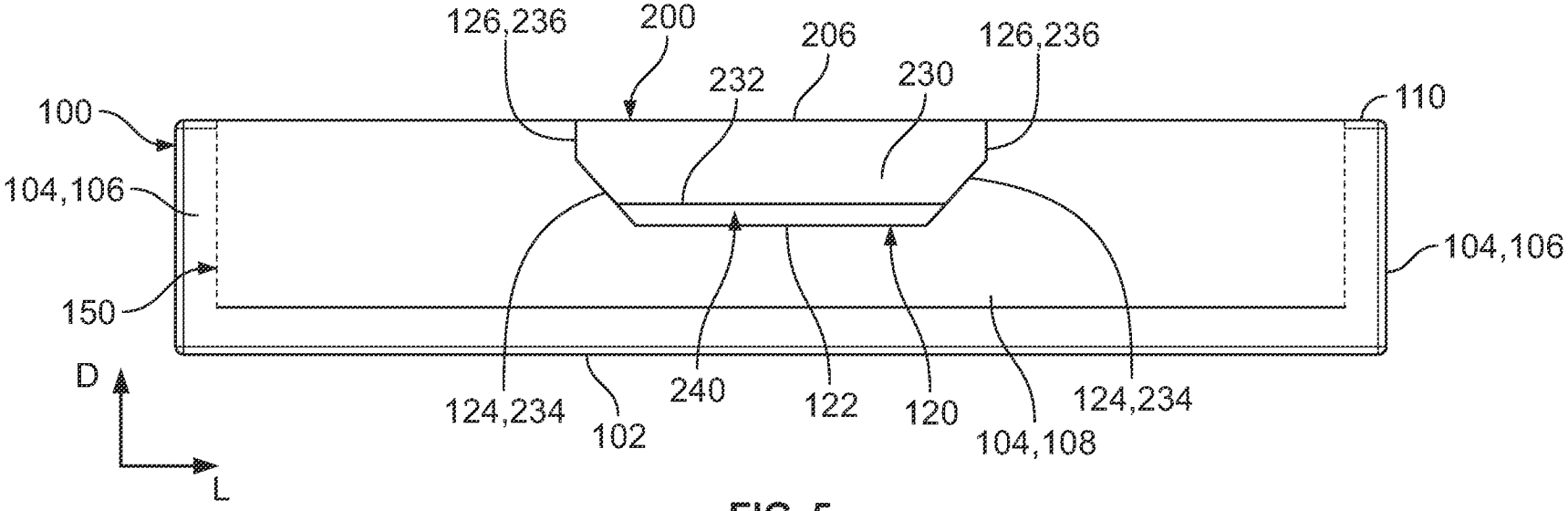
FIG. 5 is an end view of the insert disposed in the base.

As shown in FIG. 5, when the insert 200 is positioned in one of the bays 150, each of the notches 120 of the base 100 receives one of the tabs 230 of the insert 200. The slanted surfaces 234 of the tabs 230 abut the slanted surfaces 124 of the notches 120 and the upper surfaces 236 of the tabs 230 abut the upper surfaces 126 of the notches 120. The upper surfaces 126, 236 of the notch 120 and the tab 230 are straight in the depth direction D and are flush in abutment with one another. In the embodiment shown in FIG. 5, the lower surface 232 of the tab 230 is spaced apart from the lower surface 122 of the notch 120 by a gap 240 in the depth direction D. The gap 240 may be sized to receive a tool to aid in removing the insert 200 from the base 100. In another embodiment, the lower surface 232 of the tab 230 may abut the lower surface 122 of the notch 120 with no gap 240.

Figure 6B:
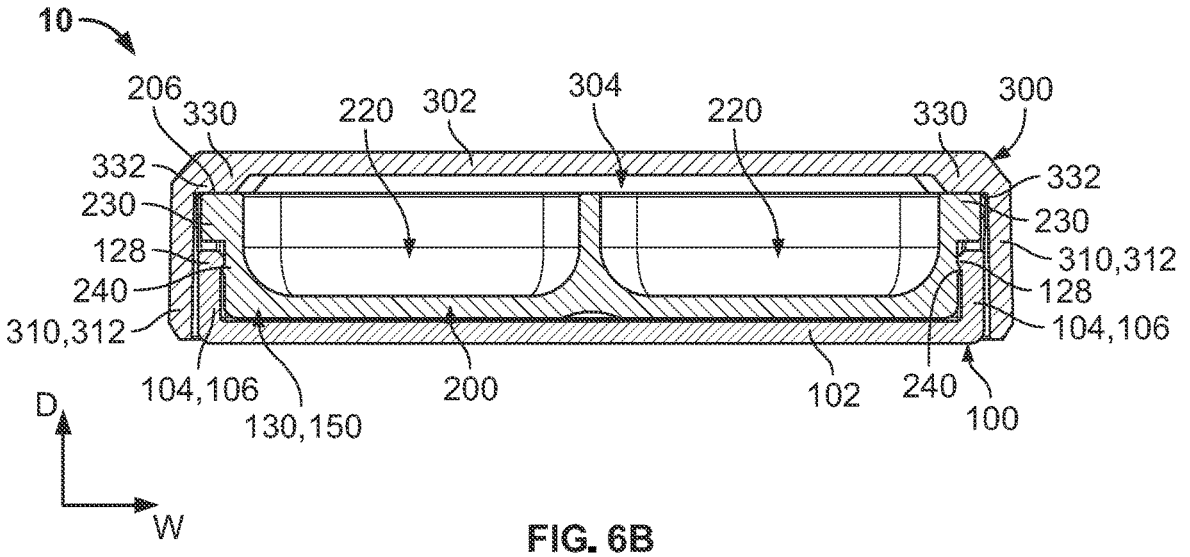
FIG. 6B is a sectional side view of the modular cosmetic container assembly.

As shown in FIG. 6B, when the insert 200 is removably positioned in the base 100, the protrusions 128 are snap-fit with the ridges 240 to secure the insert 200 in the bay 150. As the insert 200 is inserted into the bay 150 in the depth direction D, the ridges 240 contact the protrusions 128 and deflect the first walls 106 slightly outward. Once the ridges 240 pass the protrusions 128 in the depth direction D, the first walls 106 elastically return to their original position, snapping the protrusions 128 into engagement behind the ridges 240 and removably securing the insert 200 in the bay 150.

When the insert 200 is removably positioned in the bay 150, the upper surface 206 of the insert 200 is flush with the upper surface 110 of the sidewalls 104, as shown in FIG. 5; the third outer dimension 216 of the insert 200 is equal to the depth of the bay 150 in the depth direction D. The first outer dimension 212 of the insert 200 is approximately equal to an inner dimension of the bay 150 in the longitudinal direction L and the second outer dimension 214 of the insert 200 is approximately equal to an inner dimension of the bay 150 in the width direction W, such that each insert 200 fits snugly but without significant interference in each of the bays 150.

With the selected inserts 200 positioned in the bays 150 of the base 100, the lid 300 is attached to the base 100 to form the modular cosmetic container assembly 10, as shown in FIGS. 6A and 6B. The exterior dimension 112 of the base 100 is slightly, in an embodiment less than 1%, larger than the interior dimension 316 of the lid 300, such that the sidewalls 310 of the lid 300 are friction-fit with the sidewalls 104 of the base 100 to retain the lid 300 on the base 100 and contain the inserts 200 between the base 100 and the lid 300.

As shown in FIG. 6B, with the lid 300 attached to the base 100, the flat surface 332 of the inner ledge 330 abuts the upper surface 206 of the inserts 200 to further seat and hold the inserts 200 in the insert receiving space 130. The lid 300 forms an air-tight seal around the insert receiving space 130 having the bays 150 and containing the inserts 200. In the shown embodiment, in the fully assembled position of FIG. 6B, the inner surface of the upper wall 302 is spaced apart from the upper surface 206 of the insert 200 by a cavity 304 that is approximately flat and extends in the width direction W and the longitudinal direction L. The cavity 304 prevents the cosmetic material in the wells 220 from spreading to the lid 300. In various embodiments, the cavity 304 is sized to receive other elements such as a separate plastic palette that can be used to mix the cosmetic materials contained in the wells 220 of the inserts 200 or mats sized to each of the inserts 200 that provide a further waterproof and airtight seal for the cosmetic material in the inserts 200.

In use, a user can "de-pot" cosmetic or other material from its original packaging into inserts 200 having the desired well 220 sizes, and can choose a base 100 depending on the number of bays 150 of the insert receiving space 130 desired for the application. As described above, a smaller base 100 with fewer bays 150 increases portability of the assembly 10 while a larger base 100 with more bays 150 increases a total quantity of possible cosmetic or other material carried in the wells 220 of the inserts 200. The same inserts 200 are interchangeably usable with each of the bases 100 of various size, improving the modularity and flexibility of the assembly 10. The food-grade quality of the materials of the assembly 10 and the air-tight seal of the lid 300 with the base 100 further prevent spoilage of the materials in the wells 220, while the transparent materials allow a user to easily identify which materials are contained in the wells 220 without removing the lid 300. The modular cosmetic container assembly 10 according to the invention therefore improves the portability, flexibility, and usability of cosmetic materials while at least maintaining the shelf-life of the products contained within the assembly 10.

What is claimed is:

1. A modular cosmetic container assembly, comprising:

a base having a bottom wall and a plurality of sidewalls defining an insert receiving space, the plurality of sidewalls include a first sidewall and a second sidewall opposite the first sidewall, the insert receiving space is defined between the first sidewall and the second sidewall, each of the first sidewall and the second sidewall has a notch extending through the sidewall, a plurality of inserts removably insertable into the insert receiving space, each of the inserts is monolithically formed in a single piece and has a same plurality of outer dimensions and at least one well, the inserts differ in a number of the wells in each of the inserts, the insert receiving space is sized to receive at least two of the plurality of inserts that are all interchangeably positionable in the insert receiving space, each of the inserts has a tab extending from each of a pair of opposite exterior sides of the insert, one of the tabs is received in the notch extending through the first sidewall and another of the tabs is received in the notch extending through the second sidewall, the tabs are accessible from an exterior of the first sidewall and the second sidewall; and a lid attachable with the base with the inserts in the insert receiving space, the lid has a plurality of sidewalls that are friction-fit with the sidewalls of the base to form an air-tight seal around the insert receiving space.

2. The modular cosmetic container assembly of claim 1, wherein the notches have a shape complementary to the tabs.

3. The modular cosmetic container assembly of claim 2, wherein the notches and the tabs each have a lower surface, a pair of slanted surfaces extending at an angle from the lower surface, and a pair of upper surfaces extending perpendicular to the lower surface.

4. The modular cosmetic container assembly of claim 2, wherein the lower surface of the tab is spaced apart from the lower surface of the notch and the upper surfaces of the tab abut the upper surfaces of the notch when the inserts are positioned in the insert receiving space.

5. The modular cosmetic container assembly of claim 1, wherein the base has a protrusion extending from one of the sidewalls into the insert receiving space.

6. The modular cosmetic container assembly of claim 5, wherein the inserts each have a ridge protruding from the side of the insert and positioned below the tab, the ridge is snap-fit with the protrusion when the inserts are positioned in the insert receiving space.

7. The modular cosmetic container assembly of claim 1, wherein each of the wells has an inner surface with a plurality of rounded sides and corners.

8. The modular cosmetic container assembly of claim 1, wherein the wells in each of the inserts are symmetrical about at least one of a longitudinal direction of the modular cosmetic container assembly and a width direction perpendicular to the longitudinal direction.

9. The modular cosmetic container assembly of claim 1, wherein each of the inserts has two wells positioned adjacent to one another in a width direction and the number of the wells adjacent to one another in a longitudinal direction of the modular cosmetic container assembly perpendicular to the width direction varies between the inserts.

10. The modular cosmetic container assembly of claim 1, wherein the base has a plurality of dividers in the insert receiving space extending between the sidewalls and forming a plurality of bays of the base, each of the bays receives one of the inserts.

11. The modular cosmetic container assembly of claim 1, wherein an upper surface of each of the inserts is flush with an upper surface of the sidewalls when the inserts are positioned in the insert receiving space.

12. The modular cosmetic container assembly of claim 1, wherein the lid has an upper chamfer at a connection of the sidewalls and an upper wall of the lid and a lower chamfer at an end of the sidewalls opposite the upper wall.

13. The modular cosmetic container assembly of claim 1, wherein the lid has an inner ledge extending from the sidewalls, the inner ledge abuts an upper surface of the inserts in the insert receiving space when the lid is attached to the base.

14. The modular cosmetic container assembly of claim 13, wherein an upper wall of the lid is separated from the upper surface of the inserts by a cavity.

* * * * *